United States Patent [19]

Koenders et al.

[11] Patent Number: 4,768,061

[45] Date of Patent: Aug. 30, 1988

[54] DEVICE FOR THE DEVELOPMENT OF A LATENT ELECTROSTATIC IMAGE, APPARATUS FOR PRODUCING PRINTS BY ELECTROPHOTOGRAPHIC MEANS AND METHOD FOR DEVELOPING A LATENT ELECTROSTATIC IMAGE

[75] Inventors: Antonius B. T. M. Koenders, Zeddam; Theodorus P. S. Louwers, Boxmeer, both of Netherlands; Julia M. Alston, Myrtle Bank, Australia

[73] Assignee: Coulter Stork Patents B.V., Amsterdam, Netherlands

[21] Appl. No.: 17,619

[22] Filed: Feb. 24, 1987

[30] Foreign Application Priority Data

Feb. 25, 1986 [NL] Netherlands ..... 8600473
Oct. 23, 1986 [AU] Australia ..... PH8649

[51] Int. Cl.[4] ..... G03G 15/06

[52] U.S. Cl. ..... 355/14 D; 355/10; 430/103; 118/648

[58] Field of Search ..... 355/3 DD, 14 D, 10; 430/103, 117; 118/647, 648, 659, 660

[56] References Cited

U.S. PATENT DOCUMENTS

| | | | |
|---|---|---|---|
| 3,412,710 | 11/1968 | Robinson | 118/648 |
| 3,752,119 | 8/1973 | Matkan | 355/10 X |
| 3,908,037 | 9/1975 | Bickmore | 427/14 |
| 4,006,709 | 2/1977 | Miyakawa et al. | 118/648 |

*Primary Examiner*—A. T. Grimley
*Assistant Examiner*—J. Pendegrass
*Attorney, Agent, or Firm*—Watson, Cole, Grindle & Watson

[57] ABSTRACT

A device is described for developing a latent electrostatic image which is present on a surface, for example a photoconductor surface. The device has one or more regions of a first type having relatively large dimensions and one or more regions of a second type having relatively small dimensions, both dimensions being measured parallel to the direction of relative movement of the device with respect to the image surface.

The regions described may be separately and independently supplied with electric potentials.

A method is described for developing a latent electrostatic image with use of a device according to the invention whereby energizing of the first and second type regions is carried out in accordance with developer-density and/or contrast requirements.

9 Claims, 3 Drawing Sheets

DEVICE FOR THE DEVELOPMENT OF A LATENT ELECTROSTATIC IMAGE, APPARATUS FOR PRODUCING PRINTS BY ELECTROPHOTOGRAPHIC MEANS AND METHOD FOR DEVELOPING A LATENT ELECTROSTATIC IMAGE

BACKGROUND OF THE INVENTION

The invention relates firstly to a device for developing a latent electrostatic image, situated on a surface, by means of a particulate developer, in which device and image can move relatively with respect to each other and comprising at least developer supply means for the uniform application of developer, a development electrode fitted in an electrically insulated manner and developer removal means, wherein the development electrode comprises several regions which are electrically insulated with respect to each other and means are present to make it possible to supply electrical potentials, independent of each other, to said regions.

Such devices for developing latent electrostatic images are known perse from U.S. Pat. No. 3,908,037. Said publication describes the use of a development electrode which during development moves relatively to a photoconductorsurface on which a latent electrostatic image is present which has to be developed. The development is carried out with use of a dry particulate developer or toner.

The use of a development electrode which is constituted by a plurality of separately energizable regions is said to be particularly useful in case wherein repeated development occurs whereby after each development the developer is transferred to a support surface. By appropriate selection of the voltages of the different regions a cleaning effect may be obtained in which the first regions of the development electrode serve to remove residual toner (regions which precede other regions in order of being faced with a particular area of the latent image), while the later regions act in the actual development.

Such known systems have as a disadvantage that in the developed area's the uniformity in developer density is not optimal in solid and screened area's. At the edges of area's with high developer density further flow phenomena occur; this same effect is considered to be responsible for what is called "Cloudiness" in screenarea's, i.e. a non uniform screen appearance. More over a complete prevention of background developing may not always be obtained. Specially with use of liquid developers or toners afore mentioned drawbacks are even more pronounced.

SUMMARY OF THE INVENTION

The present invention aims to provide a device with which it is possible, both for dry and liquid developers to overcome said drawbacks.

Said objects are attained with a development device of the type referred to in which according to the invention the indicated electrically insulated regions are formed by one or more regions of a first type having a relatively large size when measured parallel to the direction of relative movement and one or more regions of a second type having a relative small size when measured parallel to the direction of relative movement.

As will be described herein after the development device according to the invention provides the possibility to control development uniformity, developerdensity, developer streaming, screen uniformity, background density and contrast by appropriate selection of the voltage and relative position of the first and second type regions of the development electrode.

Moreover, it has been found possible to adjust the potentials of the regions mentioned earlier, which are electrically insulated with respect to each other, in a manner such that a single development step is sufficient to be able to achieve the maximum developer density in the sections of the image which is appropriate for a certain electrostatic quantity of charge. At the same time it is possible to ensure that the background density in the sections of the image between the screen points and also between large areas is negligibly small.

More particularly, the device is characterized in that the regions of the second type are essentially surrounded by regions of the first type.

In another embodiment, which will be described later, one edge of the development electrode which is perpendicular to the direction of relative movement is an edge of a region of the second type.

It has in fact been found that a field distribution can be said to be very favourable if the regions of the second type are small with respect to the regions of the first type surrounding them.

In all cases, it is assumed that the favourable effect of the presence of regions of the second type in or near regions of the first type is associated with a controlling effect on the development process which is exercised by the regions of the second type. A final explanation of the favourable effect perceived has as yet not been found: it is suspected, however, that the controlling effect of the regions of the second type is associated with an interaction between (a) the normal field prevailing over a development gap as a consequence of the presence of the development electrode and the potential of the latent electrostatic image, (b) the leakage fields at the edges of the sections of the image whose field lines run towards the charge-free background sections and (c) the field which is produced as a consequence of the presence of the regions of the second type on the surface of the development electrode. By now energizing the regions of the second type electrically in the correct manner, it is possible to obtain an optimum coverage of the sections of the image, combined with a minimum cloudiness in the screen sections and a minimum of streaming in the solid sections and also a minimum streakiness in said sections.

Although the developer can be supplied in many ways to the gap between the image surface and the development electrode, the developer supply means will be very advantageously formed by a supply slit which is surrounded by regions of the first and/or second type and whose largest dimension is perpendicalar to the direction of the relative movement of the device.

By supplying particulate developer to the supply slit, said slit being surrounded by regions of the first and/or second type, the result will be achieved that the developer flows out in two directions over the surface of the development electrode, as a result of which a complete filling of the space between the development electrode and the surface on which the latent electrostatic image is situated is achieved. In a further very advantageous embodiment, one or more developer distribution means are incorporated in the supply slit, in which case such a developer distribution means may have the form of a rod which, in a very favourable case, extends conically from the middle to the ends.

In a particular embodiment of the device according to the invention, the development electrode is formed as a flat electrode, at least one region of the first type being present on each of the sides of the developer supply slit and at least one region of the second type being present in each of the regions of the first type.

It is obvious that the relative movement between the development device and the surface on which the latent electrostatic image is situated can take place in several manners. Thus, the surface on which the latent electrostatic image is situated may be stationary while the development device is moved across said surface. It is also possible for the development device to be stationary while the surface on which the electrostatic image is situated is moved across the development device.

In general, care will be taken to ensure that the development electrode of the development device is kept at a constant distance from the surface on which the electrostatic image is situated in order not to disturb the electrostatic field distribution in the space between development electrode and electrostatic image by variations in distance and thus to achieve as uniform a development result as possible.

In an extremely advantageous embodiment of the device according to the invention, the developer supply and removal means of the device form part of a developer circuit which incorporates circulation means, a stock container sealed off from the environment and, if required, developer mixing means.

The use of a sealed stock container is advantageous as a result of the reduced evaporation and contamination risk, as a result of which the life of the developer is considerably increased.

The developer circuit mentioned above in general incorporates closure means which are very suitably formed by one or more diaphragm valves pneumatically operated according to a desired program.

Such valves have the advantage that they are by nature essentially maintenance-free and, for example, require no regular cleaning.

Especially in the case of fluid particulate developers, i.e. electrically insulating fluids which also incorporate electrically insulating pigment particles, it is very advantageous if care is taken to ensure that the developer carrier fluid cannot be lost all too readily by evaporation. In known development devices this is often a problem; by now incorporating, according to the invention, in the developer circuit, a sealed stock container from which the developer is fed to the development device and to which the used developer is returned again, loss by evaporation is largely prevented, as a result of which the life of the developer is very favourably influenced.

The invention also relates to an apparatus for producing prints by electrophotographic means, comprising carrier means for photoconducting material, means for electrostatically charging up said material, means for imagewise exposing said charged-up photoconducting material, means for developing a latent electrostatic image formed and, if required, means for transferring the developer image formed to a receiving medium. According to the invention, such an apparatus can be equipped with one or more development devices which form the subject of the invention. This embodiment of the apparatus makes it possible to obtain excellent prints which are notable for the absence of flow phenomena and streakiness in the solids and the absence of cloudiness and background development in the screen sections and uniformity over the total image area.

Finally, the invention relates to a method for developing a latent electrostatic image situated on a surface, wherein a development electrode performs a relative movement at preselected speed across said surface at a short fixed distance and developer is supplied to the gap between development electrode and surface, in which method development takes place using at least one development electrode which is formed by a metal plate as a first type region which incorporates one or more second type regions fitted in an electrically insulated manner as described while developer is supplied through a slit extending perpendicular to the direction of relative movement. By performing such a method by means of a development electrode which contains a number of regions fitted in an electrically insulated manner embedded in its surface, it is possible to achieve a control of the field distribution in the space between the development electrode and the image surface in a manner such that the disadvantages, mentioned earlier, of non-ideal image coverage, flow phenomena, streakiness, cloudiness and lack of background cleanliness no longer exist.

More particularly in the method of the type specified use is made of a development electrode comprising at least one region of a second type and one region of a first type, said region of a second type preceding the region of a first type at commencement of developing, a control voltage is applied between the conductive backing of a surface having a latent electrostatic image and the region of a second type while a main voltage is applied between the conductive backing of a surface having a latent electrostatic image and said region of a first type whereby the voltage and polarity of the first and second type regions are preselected in accordance with developer-density and/or contrast requirements.

The method of this invention as described above is particularly applicable to the reproduction of continous tone imagery by which is meant within the present context withour limitation however thereto, firstly imagery contained on a transparency such as silver halide positive or negative film in the form of areas having variable transmission densities or tonal gradation, typically as produced by silver halide photography; secondly imagery produced by projecting onto a photoconductor a continous tone image; thirdly so-called soft dot halftone transparencies wherein the dots themselves are of variable density, typically a high density core of center with more or less density fall-off towards the edges and in certain instances a low density fringe extending some distance beyond the edges, depending on the exposure energy employed to produce such transparencies typically in scanners, as commonly used in the graphic arts industry; fourthly imagery produced by direct laser exposure of a photoconductor wherein the energy distribution of the exposing spot may not be uniform and thus the pixels or arrays of pixels generated by such spot and forming the imagery may be of variable density, similar to the previously described soft halftone dots.

It is well known to produce continuous tone imagery as above defined by electrophotographic process, for instance in monotone or color copying, in analog or digital pre-press colorproofing and the like.

The purpose of pre-press proofs as is well known in the art is to assess color balance and strength which can be expected from the final press run and accordingly to correct the separation transparencies before the printing plates are made therefrom. Thus it is essential that the pre-press proof should have the same appearance as the press print produced with printing plates made from the proofed separation films, that is to say the pre-press proof has to match the press print precisely with regards color balance and contrast.

It is known to produce by electrophotographic processes lithographic and gravure pre-press proofs containing in general four colors, such as yellow, magenta, cyan and black. Such pre-press proofing processes are disclosed for instance in U.S. Pat. Nos. 3,809,555 and 3,862,848. Apparatus for the production of electrophotographic pre-press proofs is described for instance in U.S. Pat. Nos. 4,510,223 and 4,557,583.

In the analog mode electrophotographic pre-press proofs are usually produced by charging a photoconductive recording member, followed by exposure through a separation film positive corresponding to one color, followed by developing (also called toning) of the exposed photoconductor with a liquid dispersed developer or toner of the appropriate color, followed by in-register transfer of the toner deposit to a receptor such as paper, usually of the same grade as the printing stock. These process steps are then repeated with separation film positives of the other three or more colors and appropriate color toners to produce a multi-color prepress proof.

In the digital mode electrophotographic pre-press proofs are produced by the same steps as in analog mode, except that exposure is effected by scanning the photoconductor surface with a laser beam which is modulated in accordance with the electronically processed image in digital form.

Provided the color toners used are of appropriate density, hue and grayness, in both modes of color proofing the contrast and color balance required to match the press print depend on obtaining the correct dot gain, as is well known in the art, that is to say the integrated density of particular dot percentage areas on the prepress proof must be identical to the corresponding areas on the press print. In electrophotographic analog prepress proofing dot gain mainly depends on exposure, particularly when soft dot halftone films are used, whereas in electrophotographic digital color proofing dot gain depends mainly on the energy distribution of the exposing laser spot forming pixels or arrays of pixels.

As is well known, in silver halide photography contrast is usually determined by te gamma or the so-called DlogE curve of the photosensitive material, that is a curve representing density versus exposure. In electrophotography each type of photoconductor has a specific gamma, the so-called VlogE curve, that is surface voltage versus exposure, or surface charge dissipation by exposure. The actual contrast however depends not only on the gamma of a specific photoconductor, but also on the type of toner employed to tone the photoconductor, that is on the characteristic non-linear response of the toner to different surface voltage on the photoconductor, which depends on the particle size, charge/mass ratio and other composition related factors of specific toners. Such non-linear response to the surface voltage, that is to say disproportionality between the quantity of deposited toner and the level of corresponding surface voltage is well known. For instance certain toners fail to develop low surface voltage areas in the low density or so-called to end of the gamma curve, which results in loss of information, or respond excessively to such low surface voltages, which results in background fog; other toners are non-linear in the middle portion of the curve, yet other toners fail to reproduce the high voltage or high density so-called knee end of the curve, and the like. Such non-linearity in toner response to surface voltage in combination with the limited extent to which the VlogE curve of a photoconductor can be altered by exposure renders contrast control complicated and difficult, particularly in electrophotographic analog and digital colorproofing where, as explained in the foregoing, dot gain control is essential for correct color balance and contrast, and where dot gain in the prior art could be controlled in combination with specific toners only by precise exposure of halftone films in analog mode, where in the case of soft dots the variable dot density and fringe constitute in effect continuous tone imagery, same as the variable energy distribution of the exposing spot in digital mode.

BRIEF DESCRIPTION OF THE DRAWING

The invention will now be explained by means of the drawing in which:

Referring now to FIG. 1 in detail, photoconductor 1 comprising charged and exposed photoconductive layer 2 on a grounded conductive backing 3 is mounted on support member 4 which is caused to move in the direction shown by the arrow parallel to composite electrode 5 consisting of control electrodes 6 and 7, (second type regions) which are electrically connected to each other as shown but are isolated by means of insulator 8 from main electrode 9 (first type region). Liquid toner is supplied by means not shown through slot 10 to toning gap 11 and fills same by flowing in a pattern approximately as shown by the dotted line arrows. Control electrodes 6 and 7 are connected to one terminal of control voltage supply 12, the second therminal of which is grounded. Main electrode 9 is connected to one terminal of main voltage supply 13, the second terminal of which is also grounded. It should be realized that grounding of the conductive backing 3 of the photoconductor 1 and of the second terminals of voltage supplies 12 and 13 as shown is for illustrative purposes only, in that they can be at any potential provided the potential difference between conductive backing 3 and the composite electrode 5 is maintained in accordance with the following disclosure. This illustration shows photoconductor 1 just after commencement of toning, that is just after the leading edge 14 of supporting member 4 passed over control electrodes 6 and 7.

FIG. 2 shows another configuration of a toning device useful in accordance with this invention, wherein only one control electrode 15 is employed, again preceding the main electrode 9 at commencement of toning.

Figure 1:
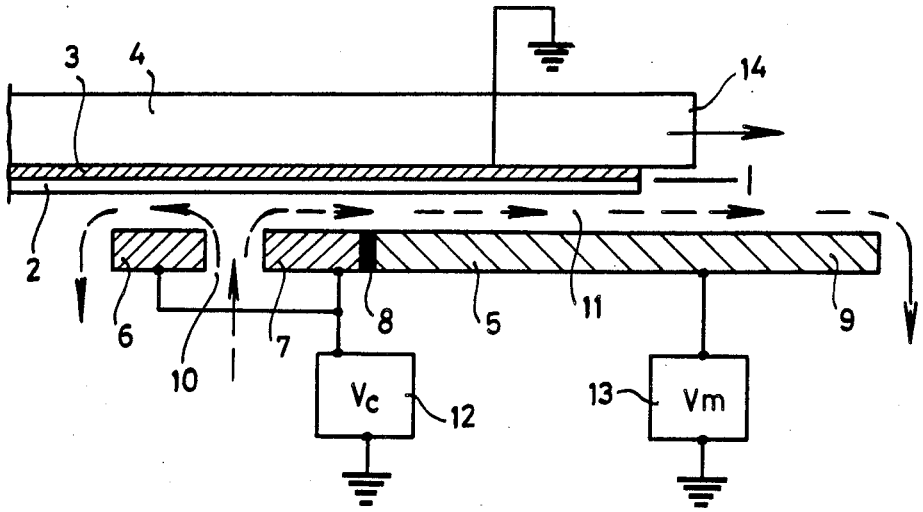
FIG. 1 illustrates a toning configuration in accordance with one embodiment of this invention, wherein the photoconductor moves across the composite electrode after commencement of toning, that is in the first toning pass.
Figure 2:
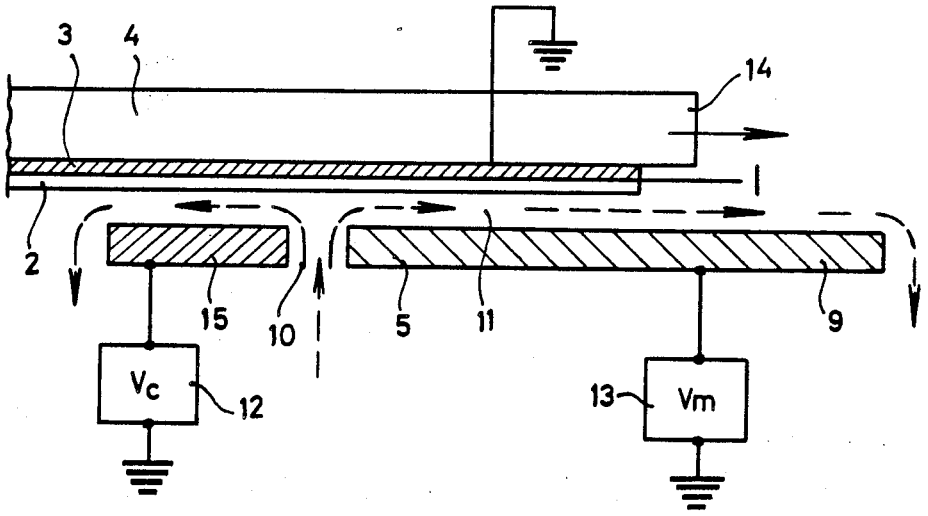
FIG. 2 illustrates another embodiment of this invention.

We have found that the contrast of imagery produced at constant exposure with a particular photoconductor toned with specific toners in a toning configuration in the embodiments of FIGS. 1 and 2 as above described depends primarily on the voltage applied to the control electrodes, whilst image density, uniformity and background fog depend on the voltage applied to the main electrode. More particularly, the main electrode voltage is determined for a specific toner in view of the desired maximum density (Dmax), image uniformity and absence of background fog, and thereafter the desired contrast is attained by forming an appropriate voltage difference between the thus fixed main electrode voltage and the control electrode voltage. Surprisingly such voltage differential between the control and main electrodes controls the toner response only in the low and mid density region without significantly affecting the desired Dmax as determined by the main electrode voltage.

We have also found that contrast control in accordance with this invention is surprisingly only possible at the commencement of toning, that is to say the control electrode or electrodes must precede the main electrode, so that the initial application of toner to the charged and exposed photoconductor accurs in the presence of the appropriate controle electrode voltage.

The voltages applied to both the control and main electrodes are preferably but not necessarily of the same polarity as that of the electrostatic charges forming latent images on the photoconductor, that is to say both types of electrodes provide so-called reverse biasing, as is well known, which counteracts toner attraction to the latent images on the photoconductor.

Without wishing to be bound by any theory, the mechanism of contrast control in accordance with this invention could be explained as follows. As stated in the foregoing, the voltage on the control electrodes affects the low and mid surface voltage or density areas on the photoconductor, without significantly affecting the high surface voltage or Dmax areas. It has been observed that in view of the weaker forces attracting toner in the low and mid surface voltage areas, toning is more critical with regards toner concentration and time of toning in attaining correct and low and mid image density than Dmax. As stated earlier, the main electrode voltage -Vm- determines Dmax and eliminates background fog by forming a depletion layer in the toner near the photoconductor surface. Thus if the control electrode voltage -Vc- is the same as Vm, from the commencement to the end of toning the same depletion layer will be maintained near the photoconductor surface and such reverse bias voltage on the electrodes will counteract toner attraction throughout toning, significantly affecting toning in low and mid density areas. If Vc is lower than Vm, that is if at commencement of toning reverse biasing is weaker and thus counteraction to toner attraction is to a lesser extent and a less depleted layer is formed near the photoconductor than by the following main electrode, at constant toning speed, toner flow and toning time more toner can be attracted to the low and mid density areas on the photoconductor, and once deposited thereon and held thereto by the latent image forming electrostatic charges, such deposited toner is not removed from the photoconductor by the subsequent higher Vm on the main electrode. Thus by forming a differential between Vm and Vc, that is decreasing or increasing the reverse biasing effect of the control electrodes over the main electrode, or even applying a forward biasing Vc, toner attraction to low and mid density areas can be controlled.

Figure 6:
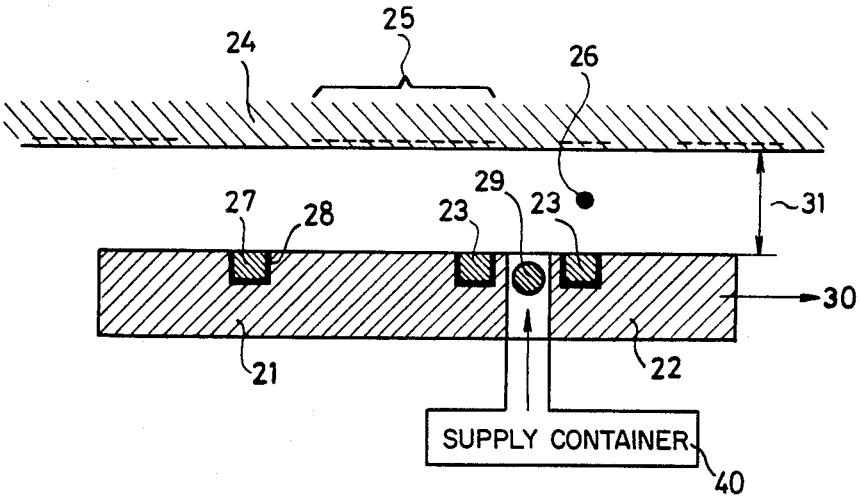
FIG. 6 shows another type of development electrode included in a device for developing a latent electrostatic image present on a surface shown in section and while developing said image.

Referring now to FIG. 6, showing an embodiment which enables primarily the control of developer density, developer uniformity, streaming of toner, background fog, screen uniformity reference numerals 21 and 22 specify two regions of the first type, while reference numerals 23 and 27 specify regions of the second type. It is assumed that, for example, the regions of the first type have a certain negative potential and the regions of the second type have a lower negative potential or even a slightly positive potential. The latent electrostatic image is situated on an image plate 24 wherein reference numeral 25 indicates an image position which is in this case strongly negatively charged. A developer particle 26 is situated in the space between development electrode and image-carrying surface. The regions of the second type 23 and 27 are embedded in regions of the first type, each region of the second type being insulated with respect to the regions of the first type by an insulation 28. The developer supply slit, which can be seen in the development electrode, incorporates a developer distribution means 29. The relative movement which the development electrode performs with respect to the image surface is indicated by an arrow 30. The developer particle 26, which is situated in the space between the development electrode and the image plate, will in this case have a positive charge with respect to its environment, as a result of which said particle experiences an electrostatic force which will drive it towards the negative charge positions on the image surface. At the same time, the particle experiences a force in the horizontal direction as a result of the supply pressure and the relative movement of the development electrode with respect to the image surface. By now making the regions of the second type with reference numerals 23 and 27 less strongly negative, at the position of said regions of the second type, the field which drives the developer particles in the direction of the image surface will increase and, in particular, in a manner such that the particles receive an additional acceleration in the direction of the image surface during a very short time, as a result of which their chance of arriving at the image surface is considerably increased. This effect results in a better converage of electrically charged areas on the image surface, and in a better adhesion between the deposited particles and the charged image surface, which in turn results in a reduced tendency to flow across the image surface, a reduction in streakiness and a reduction of cloudiness in the screen sections and of lack of background cleanliness. It is specified that the development electrode and the image surface carrying a latent electrostatic image perform a relative movement with respect to each other, it thus being possible both for the development electrode to move with respect to a stationary image surface and for the image surface to move with respect to a fixed development electrode; it has, however, been found advantageous to fix the development electrode and to cause the image surface to move with respect to said electrode. Such an arrangement has the great advantage that the connections to the image surface are only of an electrical nature, which in general presents few problems in a moving system. The connections to the development electrode are both electrical in nature and also hydraulic in nature; this last aspect relates in particular to the transport of the developer and if the development device moves, it results in an undesired risk of pinching off of leads and leakage. To maintain a constant distance between the development electrode and the image surface, various options are available; an extremely advantageous method has been found to be the installation of fixed spacers on or near the development electrode which, during the performance of the relative movement, are in sliding or rolling contact with the surface on which the latent electrostatic image is located. In this way a fixed distance can very easily be maintained and can also very easily be adjusted, if necessary, to a different fixed value. Moreover, the replacement of such spacers in the event of wear thereof is very simple to perform, while readjustment does not present any practical problem. The spacers are preferably constructed in a manner such that the developer is prevented from flowing away laterally. The development device which is embodied by the present invention is suitable for many types of applications; in this connection it is possible to think of both a simple copying apparatus and also more complicated systems. For instance, an electrophotographic colour proofing device is a good example of the more complicated systems. In such a colour proofing device screened colour separation images corresponding to yellow, magenta, cyan and black are used to make a colour proofprint which enables the lithographer to assess the quality of his diapositive films before making the forme with which printing of the colour impression has later to proceed. Such an electrophotographically operating colour proofing device incorporates, for example, four development devices according to the invention next to each other whose positions are fixed. The image plate with a latent electrostatic image formed on it is moved at a uniform speed at a fixed small distance parallel to one of the development devices, developer being supplied to the space between development electrode and image surface during the movement through the developer supply slit situated in the development electrode which has a distribution means (29) in it in the form of a rod. After completion of the development operation for the colour concerned, the development device is for example moved down while, to develop a consecutive latent electrostatic image with a consecutive colour developer, the consecutive development device concerned is raised until the spacers are in contact with the image surface. Said development operation is repeated a total of 4 times for each of the primary colours and this series of 4 development operations results in the formation of a complete screened 4-colour image on either the photoconducting surface itself or on a receiving medium if the system operates in accordance with a developer image transfer principle. In this application, the development device has proved to provide extremely good results as regards the image quality while, in addition, the adjustment and maintenance thereof can be performed extremely simply and rapidly. As shown in FIG. 6, stock container 40 includes structure for returning unused particulate toner from the development station with pump, agitator and regulator valve structure as known to those skilled in the electrostatic development art.

The following examples will serve further to illustrate this invention. For the sake of simplicity throughout these examples contrast control is illustrated by the so-called reproduction curve, that is the reflection density of the electrophotographically reproduced image -Dr- plotted against the transmission density of the original -Do- continuous tone stepwedge. The photoconductor was contact exposed to the stepwedge on a silver halide positive film. The toned images were electrostatically transferred from the photoconductor onto coated art paper.

EXAMPLE 1

In a commercially available electrophotographic color proofing apparatus the toning device configuration was substantially as shown in FIG. 1. The length of control electrodes 6 and 7 was about 30 mm and that of main electrode 5 about 120 mm. Toner was supplied through a 10 mm wide slot 10 as shown into the toning gap 11, which was 0.35 mm wide. The photoconductor comprised crystalline cadmium sulfide sputtered onto a steel substrate or backing, prepared in accordance with U.S. Pat. No. 4,269,919. The conductive steel backing was grounded, and prior to exposure the photoconductor was charged by means of a corona generator to a surface voltage of 24 Volts, negative.

A yellow color liquid toner was supplied to the toning gap, and the toning speed, that is the traversing speed of the photoconductor relative to the composite electrode, was 15 mm/second.

Four images were produced. In each case charging, exposure and all other conditions were constant, also Vm on the main electrode was kept constant at −7 Volts.

In each case however a different Vc was applied to the control electrodes. Vc varied between +1 Volt forward bias, 0 Volts, that is ground potential, −4 Volts and −8 Volts reverse bias. All these voltages related to the conductive backing of the photoconductor which was at ground potential.

Figure 3:
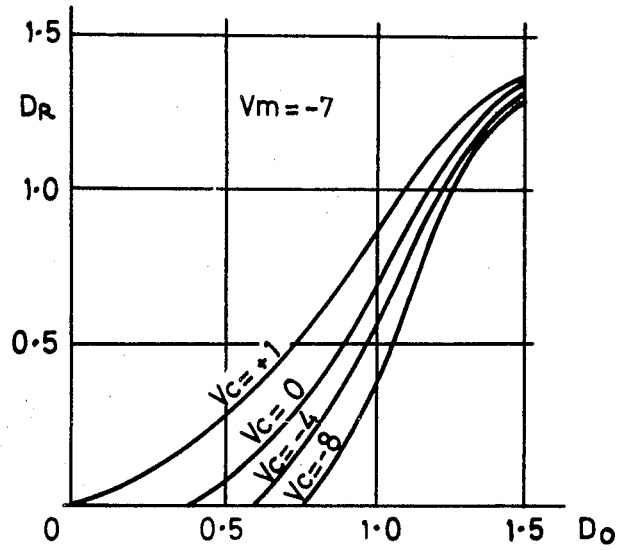
FIGS. 3, 4 and 5 are diagrams showing in relation to the included examples the contrast control of different toners attained in accordance with this invention.

The contrast control thus obtained over a wide range is illustrated by the reproduction curves as given in FIG. 3.

EXAMPLE 2

Example 1 was repeated with the exception that three images were produced with a magenta color liquid toner, and Vm on the main electrode was kept constant at −4 Volts.

Vc varied between 0 Volts ground potential, −4 Volts and −8 Volts reverse bias.

Figure 4:
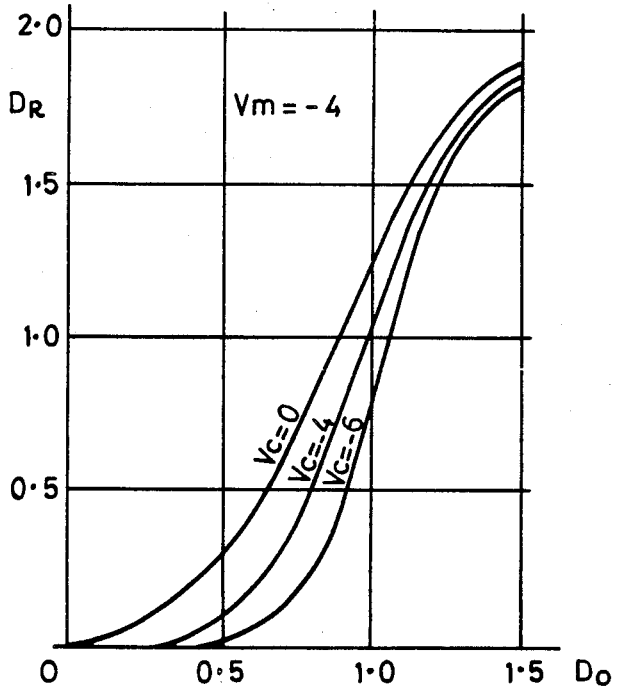

The contrast control thus obtained is illustrated by the reproduction curves as given in FIG. 4.

EXAMPLE 3

Example 1 was repeated with the exception that three images were produced with a cyan color liquid toner, and Vm on the main electrode was kept constant at −10 Volts.

Vc varied between 0 Volts ground potential, −5 Volts and −10 Volts reverse bias.

Figure 5:
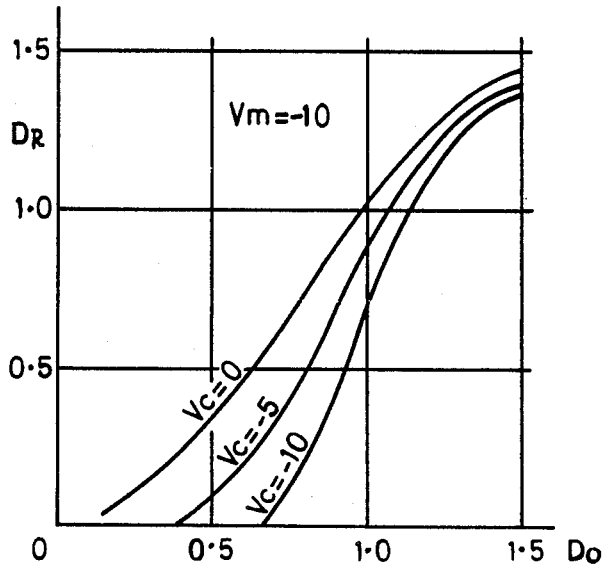

The contrast control thus obtained is illustrated by the reproduction curves as given in FIG. 5.

Whilst the embodiments illustrated in the drawings and referred to in the examples comprised a flat photoconductor in parallel motion relative to a flat composite electrode, the principles of this invention are equally applicable to other toning configurations, as will be realized by those skilled in the art, in that for instance the photoconductor may be in cylindrical form or attached to a cylinder, wherein toning is carried out whilst the cylinder is rotating past a curved composite electrode and toner is supplied to the toning gap formed therebetween.

There has been described a novel method of controlling contrast in electrophotographic imagery, and it will be realized that the contrast control as illustrated in the above examples is directly applicable to dot gain control, particularly in the case of soft dot halftone imagery, as well as to direct exposure of a photoconductor by a scanning laser beam wherein the energy distribution of the exposing spot is not uniform. Toning configuration useful in accordance with this invention has also been described. The embodiments as disclosed and the examples as given are intended to be construed in illustrative sense only, without restricting the scope of this invention.

What is claimed is:

1. Device for developing a latent electrostatic image, situated on a surface, by means of particulate developer, in which the device and image can move relatively with respect to each other and comprising at least developer supply means for the uniform application of developer, a development electrode fitted in an electrically insulated manner and developer removal means, wherein the development electrode comprises several regions which are electrically insulating with respect to each other and means present to make it possible to supply electrical potentials, independent of each other, to said regions in which the regions are formed by one or more regions of a first type having relatively large size when measured parallel to the direction of relative movement and one or more regions of a second type having relatively small size when measured parallel to the direction of relative movement, both types of regions extending over the full width of the development electrode and perpendicular to the direction of relative movement, said developer supply means comprising a supply slit which is surrounded by regions of the first and/or second type and whose largest dimension is perpendicular to the direction of the relative movement of the device; said first and second type regions being independently energizable to a preselected voltage and polarity in order to improve developer density uniformity, prevent background density and control contrast.

2. Device according to claim 1, in which the regions of the second type are essentially surrounded by regions of the first type.

3. Device according to claim 1 in which of the development electrode regions of first and second types are arranged such that of said electrode one edge perpendicular to the direction of relative movement is the edge of a region of the second type whereas the opposite edge of the development electrode constitutes an edge of a region of the first type.

4. Device according to claim 1 in which the supply slit incorporates one or more developer distribution means having the form of a rod and extending conically from the middle to the ends.

5. Device according to claim 1 in which the development electrode is formed as a flat electrode, at least one region of the first type being present on each of the sides of the development supply slit and at least one region of the second type being present in at least one of the regions of the first type.

6. Device according to claim 1 in which the developer supply and removal means of the device form part of a developer circuit which incorporates circulation means, a stock container sealed off from the environment and developer mixing means, said developer circuit incorporating closure means which can be operated in a programmed manner such as one or more diaphragm valves.

7. Apparatus for producing prints by electrophotographic means in which the apparatus and image can move relative to one another, comprising carrier means for photoconducting material, means for electrostatically charging said material, means for imagewise exposing said charged-up photoconducting material, means for developing a formed latent electrostatic image, means for transferring the formed developer image to a receiving medium, developer supply means for the uniform application of developer, a development electrode fitted in an electrically insulated manner and developer removal means, wherein the development electrode comprises several regions which are electrically insulating with respect to each other and means to supply electrical potentials, independent of each other, to said regions in which the regions are formed by one or more regions of a first type having relatively large size when measured parallel to the direction of relative movement and one or more regions of a second type having relatively small size when measured parallel to the direction of relative movement, both types of regions extending over the full width of the development electrode and perpendicular to the direction of relative movement, said developer supply means comprising a supply slit which is surrounded by regions of the first and/or second type and whose largest dimension is perpendicular to the direction of the relative movement of the device; said first and second type regions being independently energizable to a preselected voltage and polarity to improve developer density uniformly, prevent background density and control contrast.

8. Method for developing a latent electrostatic image situated on a surface, comprising:

moving a development electrode at a preselected speed across said surface at a short fixed distance therefrom to provide relative movement between said surface and said development electrode;

supplying developer to the gap between the development electrode and the surface through a slit extending perpendicular to the direction of relative movement;

developing the image using a development electrode formed by a metal plate mounted in an electrically insulated manner as a first type region incorporating one or more second type regions, the metal plate as a first type region being of relatively large size when measured parallel to the direction of relative movement and said second type regions being of relatively small size when measured parallel to the direction of relative movement both types of regions extending over the full width of the development electrode and perpendicular to the direction of relative movement; and separately energizing both said metal plate and said first and second type regions at a preselected potential.

9. Method according to claim 8, wherein the step of developing uses a development electrode comprising at least one region of a second type and one region of a first type, said region of the a second type preceding the region of the first type at commencement of the developing; and further comprising the steps of applying a control voltage between a conductive backing of a surface having a latent electrostatic image and the region of the second type; and applying a main voltage between the conductive backing of a surface having a latent electrostatic image and said region of a first type, whereby the voltage and polarity of the first and second type regions are preselected in accordance with at least one of developer density and contrast.

* * * * *